US005122064A

United States Patent [19]

Zarreii

[11] Patent Number: 5,122,064

[45] Date of Patent: Jun. 16, 1992

[54] SOLDERLESS SURFACE-MOUNT ELECTRICAL CONNECTOR

[75] Inventor: Mansour Zarreii, Mechanicsburg, Pa.

[73] Assignee: Amp Incorporated, Harrisburg, Pa.

[21] Appl. No.: 704,519

[22] Filed: May 23, 1991

[51] Int. Cl.[5] ..... H01R 9/09

[52] U.S. Cl. ..... 439/65; 439/79

[58] Field of Search ..... 439/65, 69, 73, 79-82

[56] References Cited

U.S. PATENT DOCUMENTS

| | | | |
|---|---|---|---|
| 3,629,185 | 12/1971 | Schneble, Jr. et al. | 260/40 R |
| 3,745,045 | 7/1973 | Brenneman et al. | 117/212 |
| 3,985,413 | 10/1976 | Evans | 339/17 LM |
| 4,186,982 | 2/1980 | Cobaugh et al. | 339/17 C |
| 4,386,815 | 6/1983 | Carter et al. | 339/17 M |
| 4,439,000 | 3/1984 | Kaufman et al. | 339/176 MP |
| 4,511,597 | 4/1985 | Teng et al. | 427/53.1 |
| 4,532,152 | 7/1985 | Elarde | 427/96 |
| 4,550,959 | 11/1985 | Grabbe et al. | 339/9 E |
| 4,583,807 | 4/1986 | Kaufman et al. | 339/125 R |
| 4,587,596 | 5/1986 | Bunnell | 361/398 |
| 4,588,456 | 5/1986 | Dery et al. | 156/52 |
| 4,604,799 | 8/1986 | Gurol | 29/897 |
| 4,676,565 | 6/1987 | Reichardt | 439/79 |
| 4,693,529 | 9/1987 | Stillie | 439/67 |
| 4,693,530 | 9/1987 | Stillie et al. | 439/67 |
| 4,719,809 | 3/1988 | Dery et al. | 156/306.6 |
| 4,752,231 | 6/1988 | Olsson | 439/66 |
| 4,872,844 | 10/1989 | Grebe et al. | 439/69 |
| 4,881,901 | 11/1989 | Mendenhall et al. | 439/65 |
| 4,997,390 | 3/1991 | Scholz et al. | 439/79 |

OTHER PUBLICATIONS

AMP Catalog 85-774, Issued 12-85, "AMPLIFEX Surface -to -Surface Resilient Connectors", 12/85; AMP Incorporated, Harrisburg, PA.

*Primary Examiner*—Paula A. Bradley
*Attorney, Agent, or Firm*—Anton P. Ness

[57] ABSTRACT

An electrical connector (50) includes a molded plastic housing (52) including circuit paths (74,78,82) plated or coated on its surface and extending from rows of cavities (68) to another region to define one or more rows of contact pads (90,92,93,94) to be bonded and electrically joined to pads (36) of a daughter board (20) through a conductive material. The connector (50) is mountable to a daughter card (20) by mechanical fastening to establish electrical connections therewith without solder, by using conductive tape or conductive elastomeric material. A compliant spring end portion (44) of a contact (42) is inserted in each cavity (68) so that a pin contact section thereof extends outwardly from a mating face to mate with a socket contact of a connector (18) mounted on a mother board (12), and is electrically connected to contact pads (90,92,93,94) without solder.

20 Claims, 9 Drawing Sheets

SOLDERLESS SURFACE-MOUNT ELECTRICAL CONNECTOR

FIELD OF THE INVENTION

This invention relates to electrical connectors, assemblies and systems for interconnecting circuit paths such as between printed circuit boards, and more particularly to connectors surface mountable to daughter boards without solder.

BACKGROUND OF THE INVENTION

Electrical connections between daughter card and a mother board commonly involve connectors mounted on the leading edges of the daughter cards and matable with connectors mounted on the mother board, where the daughter card connector includes an array of contacts extending through a dielectric housing usually in a plurality of rows, and each terminal includes a contact section at each end such as a pin. Commonly the daughter cards are matable at right angles to the mother board, and the pin contact sections connected to the daughter card include a right angle bend so that the pin contact sections extend parallel to the mother board and are received into usually conductively plated through-holes of the daughter card and are soldered to form the connections to the circuits of the daughter card, while the opposed pin contact sections are received into socket contacts in the mother board connector.

In another form of connector, the contact sections associated with the daughter card are adapted to be soldered to pads of the circuits on the surface of the card, and include feet bent to extend parallel to the surface of the daughter card. Where the contacts comprise a plurality of rows, it is far more practical to provide contacts of different lengths for the different rows so that the feet all are disposed in a common plane, rather than space the pads of the daughter card extremely close together to accommodate connections to three rows of contacts, for example, corresponding to three rows on the mother board. But in such an arrangement the row of surface mount soldered terminations closest to the card's edge is exceedingly difficult to inspect visually as is essential to ascertain assurance of satisfactory solder joints, since they are obscured by the contacts extending to the terminations of the other rows.

It is desirable to provide a daughter card connector which is mountable to the daughter card in a manner not requiring an array of through-holes, which must be drilled through the card at precise locations.

It is also desirable to provide a daughter card connector which is mountable to a daughter card without requiring soldering of the terminations to establish electrical connections between contact means of the connector and the circuits of the card.

It is further desirable to provide such a connector which is easily demountable from the daughter card without desoldering of terminations, for repair or replacement.

SUMMARY OF THE INVENTION

The present invention achieves the foregoing objectives and overcomes the problems outlined in the background of the invention by the provision of a connector made to include circuit paths extending from pin contacts matable with a mother board connector contact means to an array of conductive pads disposed on a common housing surface parallel to a major surface of the daughter card to be electrically connected to the mother board. In one preferred embodiment, the connector of the invention includes a housing molded of standard thermoplastic engineering material of a type having characteristics suitable for plating or coating with conductive material. The connector includes rows of cavities which are plated with circuit paths extending out of such cavities across the surface of the connector to another region to define a row of contact pads.

A compliant spring end portion of a contact is inserted in each cavity and has a contact section at the other end thereof at least exposed along a mating face and is adapted to mate with a respective corresponding contact means of a mating connector mounted on a first circuit board; the first circuit board typically is a mother board having multiple second or daughter boards or cards mounted and connected thereto.

The connector is to be mounted to the daughter card at the edge thereof by mechanical means such as bolt fasteners through apertured mounting flanges at ends of the connector and corresponding holes of the daughter card. The conductive pads of the circuit paths are electrically joined to the daughter card in one embodiment through a conductive material bonding and electrically joining the connector pads to the board pads. This provision allows the connector to be mounted on a daughter card following the loading of such card with components and the soldering of such cards to interconnect the components mounted thereon.

In another embodiment, each of the conductive pads includes a deposit of conductive elastomeric material having a height dimension to extend outwardly from the housing surface for compressible engagement with the surface of the daughter card to establish an electrical connection having sufficient normal force.

The use of plated or coated circuit paths placed directly on the connector improves the R, L, and C values inherent in prior art connectors having stamped and formed terminals with free-standing tails bent at right angles to be inserted in daughter card plated-through holes, and each path may be of a minimum length and of a selected geometry and position, relative to the dielectric housing, to minimize the effects of the connector on digital pulses transmitted therethrough. The connector, by virtue of the disposition of the conductive paths formed thereon, saves board space and allows the positioning of transceiver chips or other devices proximate to the connector to further reduce the effects of circuit board paths, vias and relatively long lengths, turns, and transitions used in conventional board manufacturing. In a further version of the invention, an etched circuit film is made to form the paths mounted and bound to the housing surfaces of the connector.

It is an object of the invention to provide a surface-mount connector which is connected to the daughter board without any soldering, and is easily demountable therefrom.

It is another object to provide a novel connector structure utilizing conventional, low-cost plastic materials in conjunction with readily formed conductive paths to improve connector performance relative to traditional constructions, including the saving of space on boards and the facilitation of placement of transceiver elements or other active devices proximate to the connector structure to facilitate high speed signal transmission.

It is yet another object to provide a novel connector construction utilizing plated-through cavities and plated circuit paths in conjunction with a compliant pin contact. Still another object is to provide an interconnection of such connector through the use of conductive adhesive or gel or conductive elastomer electrically joining pads of the connector to pads of circuit paths of circuit elements to form an improved assembly and package for high-speed digital signal transmission.

Embodiments of the present invention will now be described by way of example with reference to the accompanying drawings.

DETAILED DESCRIPTION OF THE INVENTION

Figure 1:
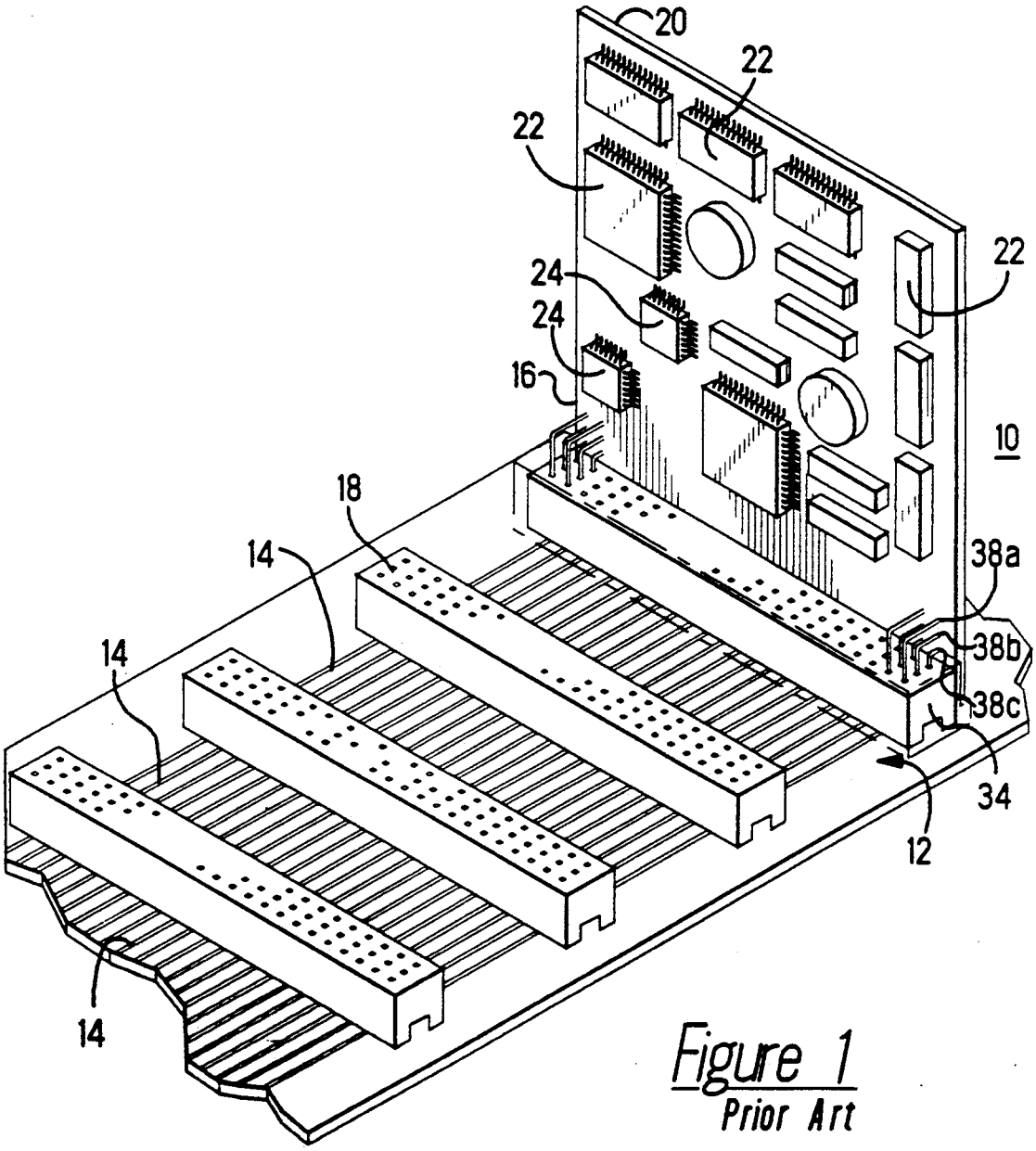
Figure 1 Prior Art
FIG. 1 is a perspective showing a conventional arrangement of daughter board, mother board, connectors and components.

In FIG. 1, an assembly 10 is shown which typifies a widespread multi-bus computer architecture. The assembly includes a mother board 12 containing therewithin multiple buses 14 which are terminated to positions along the surface of board 12 called slots or stubs 16. Each of the stubs 16 includes a connector 18 mounted on the surface of board 12, a mating connector shown as 34, a daughter board 20 containing numerous circuits and components to perform desired functions; only one such daughter board 20 is shown.

Reference is made to a publication "Versatile Backplane Bus, ANSI/IEEE Standard 10H-1987" published by the IEEE, New York, N.Y., copyright 1988, for a description of one type of architecture under discussion, although in principle most multicard systems with backplanes are constructed similarly.

Daughter board 20 includes, for example, components 22 which may represent integrated circuits performing logic or memory functions, as well as many other components including transceiver chips 24 which receive and transmit signals passed through buses 14, connectors 18, connectors 34, and various conductive paths within daughter board 20. Leads 26 from transceiver element 24 would then be interconnected to the components being driven by or driving element 24.

Figure 2:
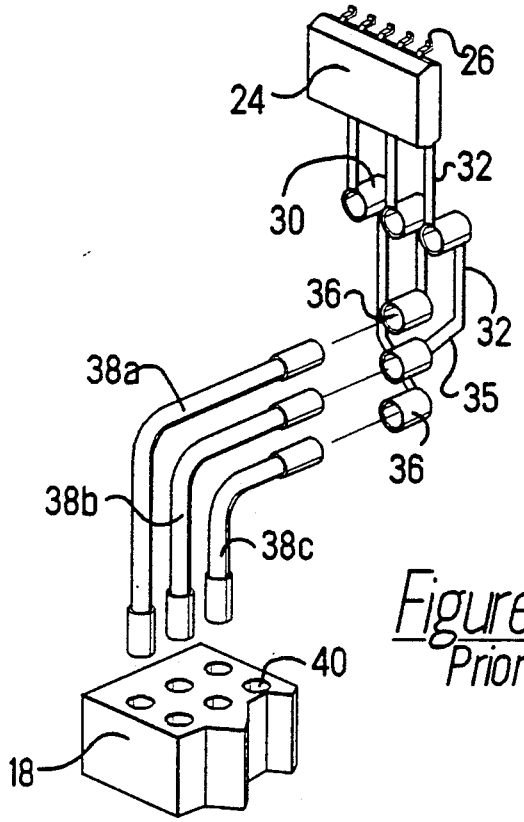
Figure 2 Prior Art
FIG. 2 is a schematic showing in perspective the conductive components forming a typical circuit path, with dielectric support material removed for clarity.

FIG. 2 represents the physical conductive paths forming the circuits of the right angle contacts interconnecting mother board connector contacts and daughter board plated-through holes in the conventional arrangement shown in FIG. 1. It is important to realize that each of the components forming the conductive paths makes a contribution to the overall circuit "seen" by signals passing to and from bus 14, connectors 18 and 34, the various leads therefrom, and the traces from within daughter board 20. Thus, for example, daughter board 20 includes transceiver chip 24 having leads 26 which plug into and are soldered to or otherwise interconnected to plated-through holes 30, or optionally surface mounted to pads, which are electrically connected to conductive paths 32 formed within daughter board 20, within laminated dielectric layers. Paths 32 extend through various bends such as at 35 to join further plated-through holes 36 in a pattern, typically in a row to be interconnected to the contacts of connector 34, three of which are shown as **38*a*,38*b*,38*c*. These contacts include bends as indicated and terminate in pin portions which plug into receptacle contacts 40 within connectors 18. Receptacle contacts 40 are in turn interconnected to the conductive paths of buses 14**.

A signal passing along a bus 14 "sees" all of these various elements in terms of resistance (R), inductance (L), and capacitance (C). The signals on buses 14 thus experience a combination of these parameters forming a characteristic impedance which effects the propagation delays of the signals passing through the various conductive paths and plated-through holes to reach transceiver chip 24. The purpose of transceiver chip 24 is to isolate or deload buses 14 from the stubs formed by daughter boards 20 and the various circuit components thereon as well as the circuits therein.

In typical practice, boards 20 are laid out and provided with components to perform certain circuit functions with the various chips and logic and memory devices typically being different and differently positioned on the boards, along with the various transceiver chips.

Figure 3:
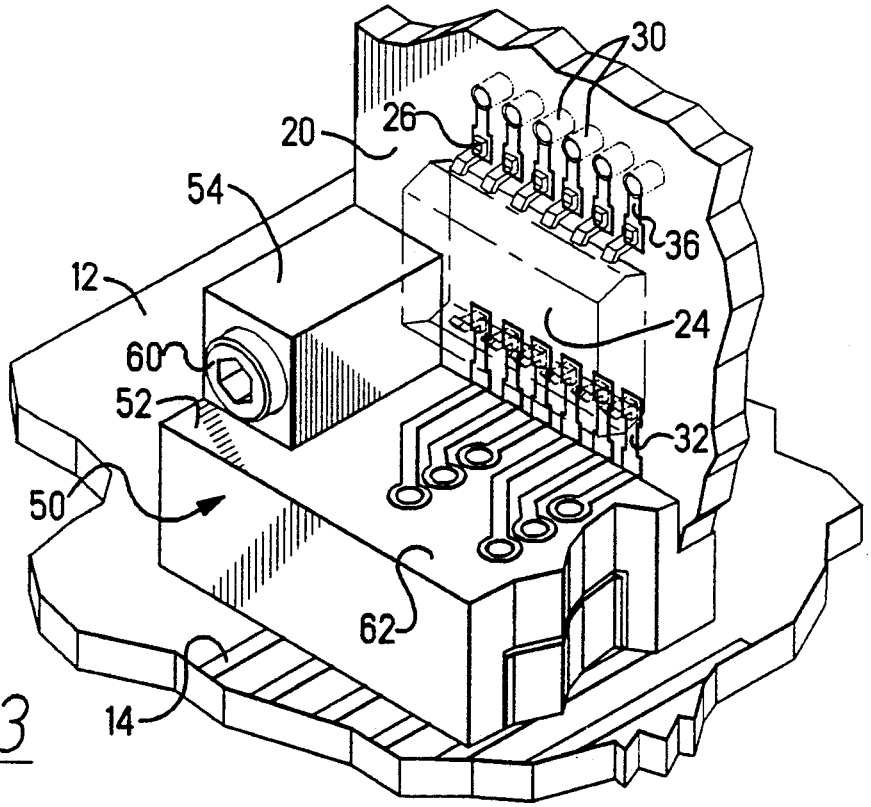
FIG. 3 is a perspective showing in part a mother and daughter board interconnected by a connector embodying details of the invention.
Figure 4:
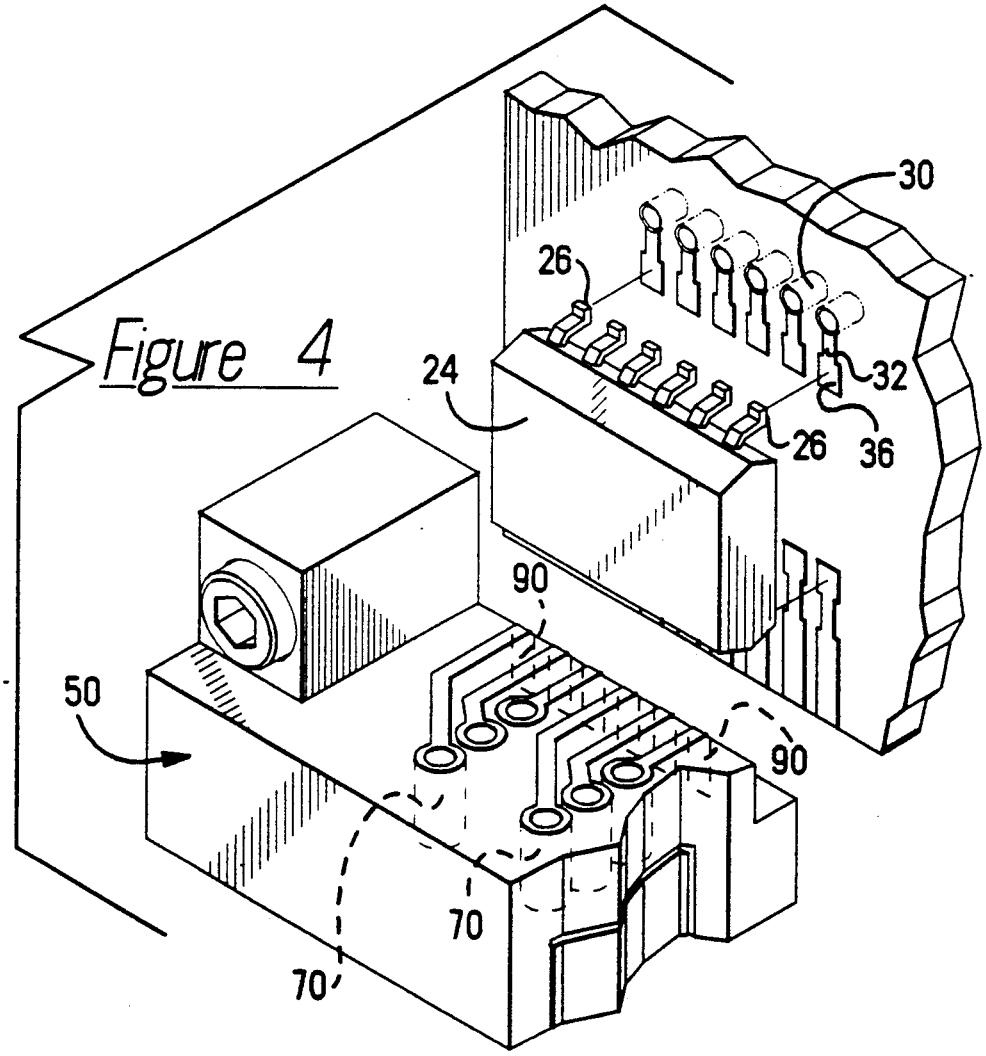
FIG. 4 is a view similar to FIG. 3 with the connector exploded from the daughter board.

In U.S. Pat. No. 4,583,807 granted Apr. 22, 1986, a daughter board connector is shown wherein the contact elements for a surface-mounted right angle connector, those equivalent to contact elements **38*a*,38*b*,38*c* shown in FIG. 1 and in FIG. 3 are each given different thicknesses in an attempt to hold the resistances of the conductive paths of the several rows of contacts to be identical. U.S. Pat. No. 4,676,565 granted Jun. 30, 1987 shows a connector for a similar use with respect to a daughter board wherein the connector contacts have tails or bends comparable to those shown in the previously mentioned patent, the equivalent represented by elements 38*a*,38*b*,38*c* in FIGS. 1 and 2**, with bends to place the contacts close to the rear face of the connector housing. One advantage of this is taught as being the reduction of the shadow or footprint of the connector upon the printed circuit board reducing the amount of space occupied by the connector.

Both of the foregoing prior art patents mention relatively high numbers of contacts for such connectors as for example ninety-six contacts in three rows which must be employed to accommodate circuit boards. Both also evidence the need for attention on the one hand to electrical parameters and on the other hand to space saving features in connectors.

FIG. 3 shows an arrangement which can be visualized in the context of FIG. 1 in relation to mother board 12, buses 14, connector 18 and a daughter board 20. As can be discerned, a connector 50 of a different geometry from that of connector 34 shown in FIG. 1 has a geometry, including the conductive paths and contacts, facilitating a movement of transceiver chip 24 downward on board 20 and very close to the connector. As a result of this, the transmission line aspects of the various conductive paths are shortened. This means that, apart from anything else and as a direct result of the change of geometry of connector 50, the values R, L, and C and Z are reduced to improve performance with respect to signal transmission.

Additionally, connector 50 has a housing 52 formed of a plastic material of a type readily plated with the plating forming conductive paths bound to the surfaces of the housing rather than separately formed and fastened thereto as in the patents hereinafter mentioned. The plastic material may be any one of a number of plastic materials having surface characteristics facilitating plating thereon.

Figure 5:
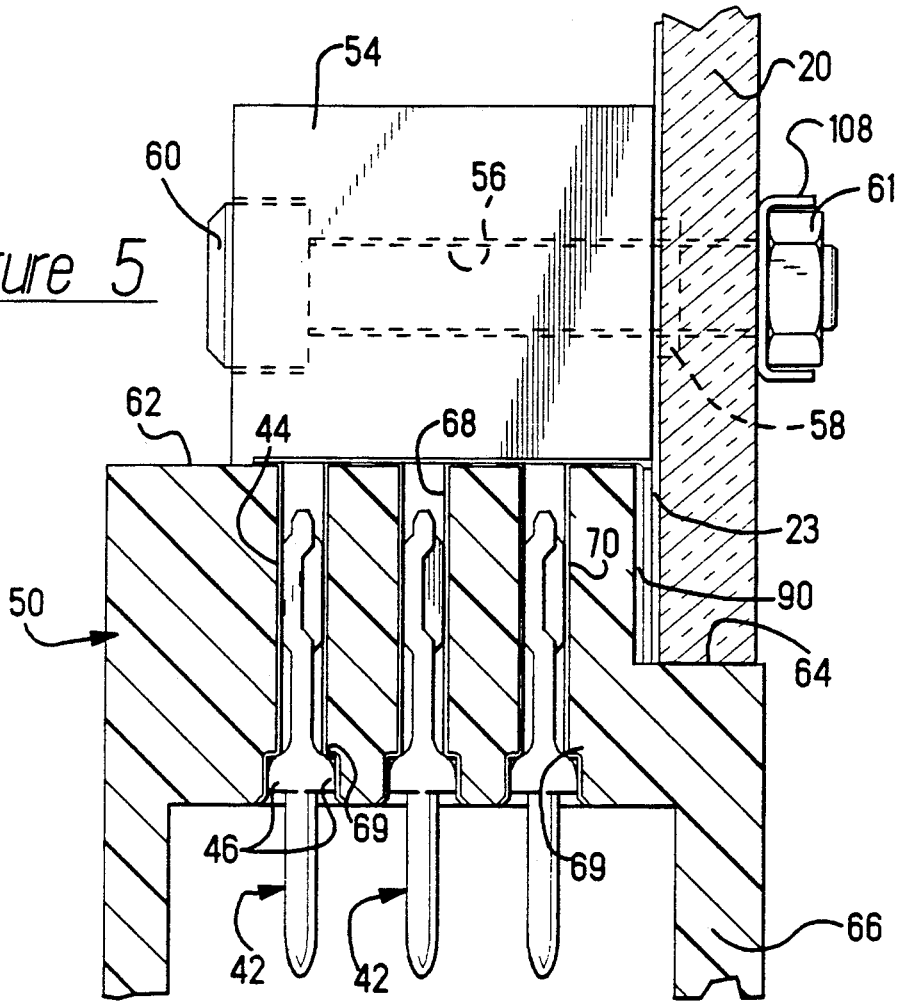
FIG. 5 is a section, in elevation, of a portion of the connector shown in FIG. 3.
Figure 7:
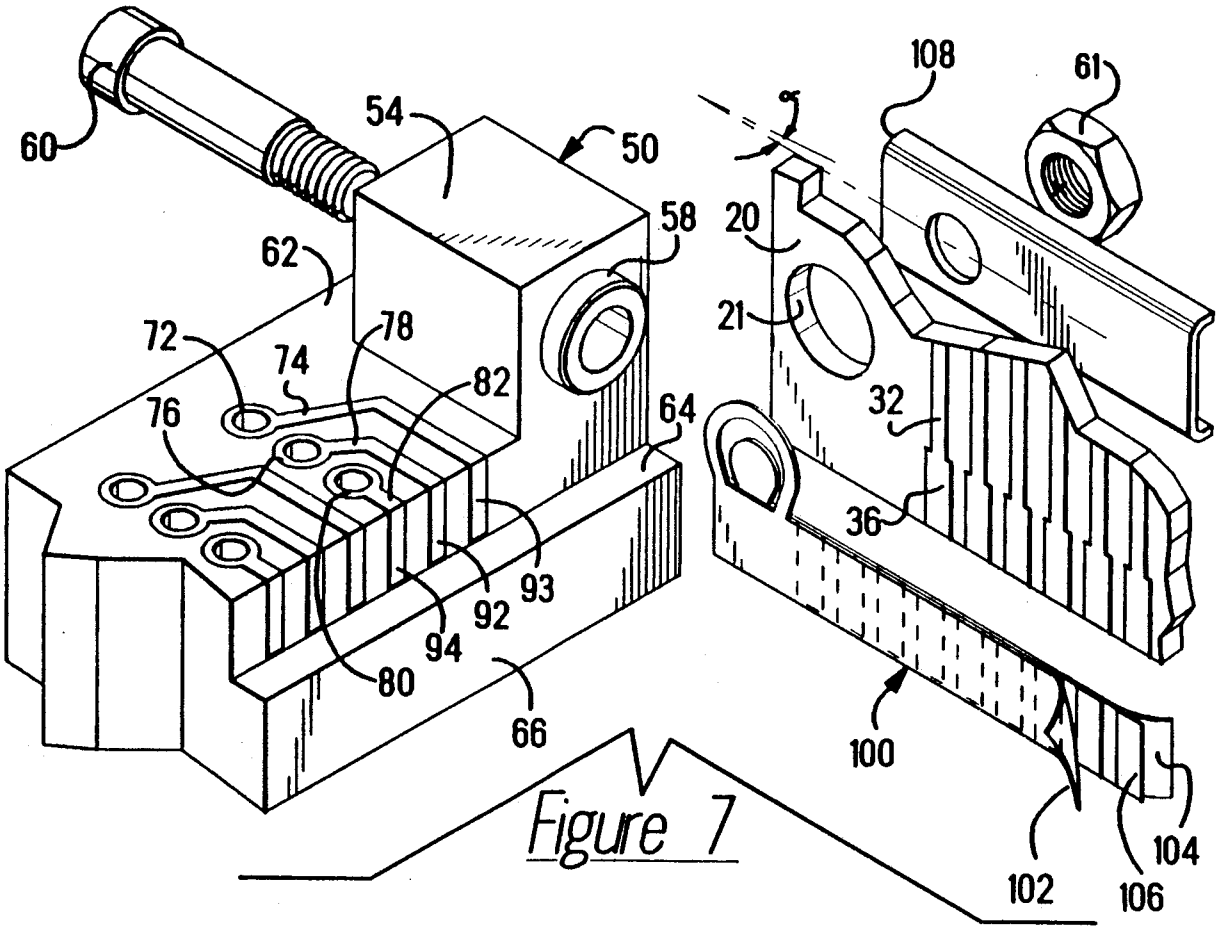
FIG. 7 is a perspective view showing the connector of FIGS. 3 to 6 having the daughter board removed therefrom and positioned preparatory to mounting the daughter board on the connector.

Housing 52 of connector 50 includes at each end, one end being shown in FIG. 3, a mounting flange 54 apertured as shown in FIG. 5 to include a cavity 56 carrying a fastener 60, a bolt in this embodiment, extending through cavity 56 to lock connector 50 to daughter board 20. As shown in FIG. 5, a nut 61 attaches to bolt 60 for this purpose. As shown in FIG. 7, mounting flange 54 further includes a small circular projection 58 which cooperates with an aperture 21 in daughter board 20 to align and position the board relative to the connector, thus registering the array of pads 92,93,94 with the respective array of pads 36 of daughter board 20.

As can be seen in FIG. 3 and in FIG. 5, housing 52 includes an upper surface 62 which leads to a step and a further surface 64 accommodating the butt end of board 20. The housing also includes shroud 66 in the manner shown in FIG. 5 which surrounds, aligns, and guides connector 50 relative to engagement with the outer walls of connector 18 mounted on board 12. Shroud 66 defines a cavity and surrounds a series of pin contacts 42 extend therein to engage the contacts as previously mentioned in connector 18. Contacts 42 extend within further cavities 68 in the body of housing 52 leading to surface 62 on the upper face of the housing.

As can be seen in FIG. 7, a number of rows of cavities 68 are provided, three being shown, with each of the rows including cavities containing conductive paths such as 76 and 80 extending out onto surface 62. Path 76 continues as at 78 and path 80 continues as at 82 to join a series of pads in a single row on a step surface of housing 52. The pads are shown as 90,92,93,94 and are made to be on centers corresponding to conductive paths 32 in board 20 which, in the embodiment shown in FIG. 7, conclude in pads 36 on the surface of daughter board 20.

Since fasteners 60 are disposed in flanges 58 at each end of connector 50 and the connector may be rather long, it is desirable to provide a means for assuring that all conductive pads 36 of daughter board 20 are assuredly pressed against pads 92,93,94 of connector 50, especially at the center of the connector. Clamping bar 108 is shown mountable relatively behind the array of pads 36, by nuts 61 fastened onto bolts 60; clamping bar 108 is preferably slightly arcuate so that upon being fastened it urges the daughter board 20 toward connector 50 more forcefully at the center, by virtue of ends of the bar initially being at a slight angle $\alpha$ such as will result in a displacement of about 0.100 inches at each mounting end with respect to board 20 and extending away from the board surface when unfastened, and flush when fully fastened. When connector 50 is firmly fastened to board 20 by fasteners 60,61, the center portion of the edge of board 20 will be forced to assume a gentle arc extending toward connector 50 between mounting flanges 54 thus assuring that even the centermost of pads 92,93,94 remain in electrical engagement with board pads 36 during in-service use.

In accordance with a further aspect of the invention, a tape 100 is shown in FIG. 7 is provided which is comprised of two peelable tapes 102 and 104, one of the tapes 102 carrying a series of pads 106 of conductive material. Pads 106 are made to be on centers corresponding to pads 36 on board 20 and pads 90,92,93,94 on connector 50. In practice, tape 104 is removed from tape 102, and the thus exposed surface of tape 102 is pressed against the surface of board 20 and conductive pads 106 bonded to pads 36. Thereafter, tape 102 may be peeled off, removed, and board 20 applied to connector 50, projection 58 entering aperture 21 to align the two elements together and the board pressed against the connector and held thereto by bolt 60 and nut 61 in the manner shown in FIG. 7. Such tape can be of the anisotropic conductive material disclosed in U.S. Pat. No. 4,588,456 made to be 5 mils thick.

Figure 6:
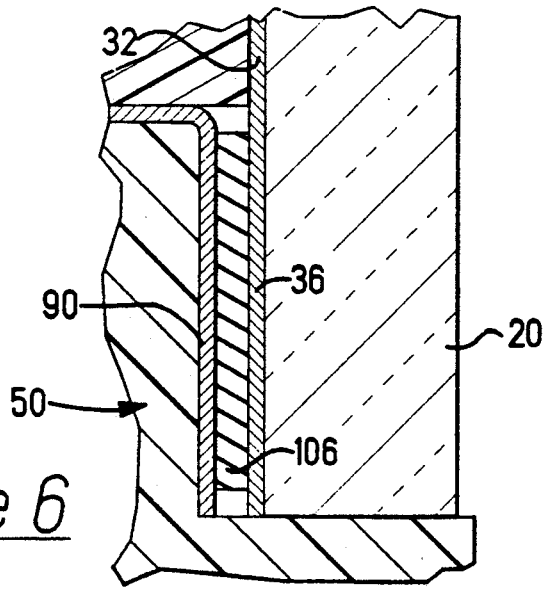
FIG. 6 is an enlarged sectional and elevational view of the detail of the connector shown in FIG. 5.

Conductive pads 106 may be, in one embodiment, formed of a conductive elastomer of a type wherein a dielectric and resilient material is loaded with conductive particles such as silver platelets, silver balls, or particles, or silver plated resilient particles or silver plated nickel particles which, under the pressure, driving pads 36 against pads 90,92,93,94, are brought into engagement to provide a low-resistance, stable interface. The invention also contemplates the use of conductive adhesive wherein a one or two part adhesive system, such as an anisotropic adhesive as disclosed in U.S. Pat. No. 4,729,809, is loaded with conductive particles which are forced together under pressure to provide a conductive paths which is more permanent than that of the elastomer. FIG. 6 shows the latter with the material of 106 joining pads 36 and 90 electrically. The invention contemplates that pads 106 are substrate-like conductive material, coated or bonded, resilient or rigid, sufficiently thin to minimize resistance and interconnect the elements. A single layer of anisotropic conductive material may be used coating the various pads 92,93,94 in lieu of separate pads 106 to effect interconnection of the elements.

Figure 8:
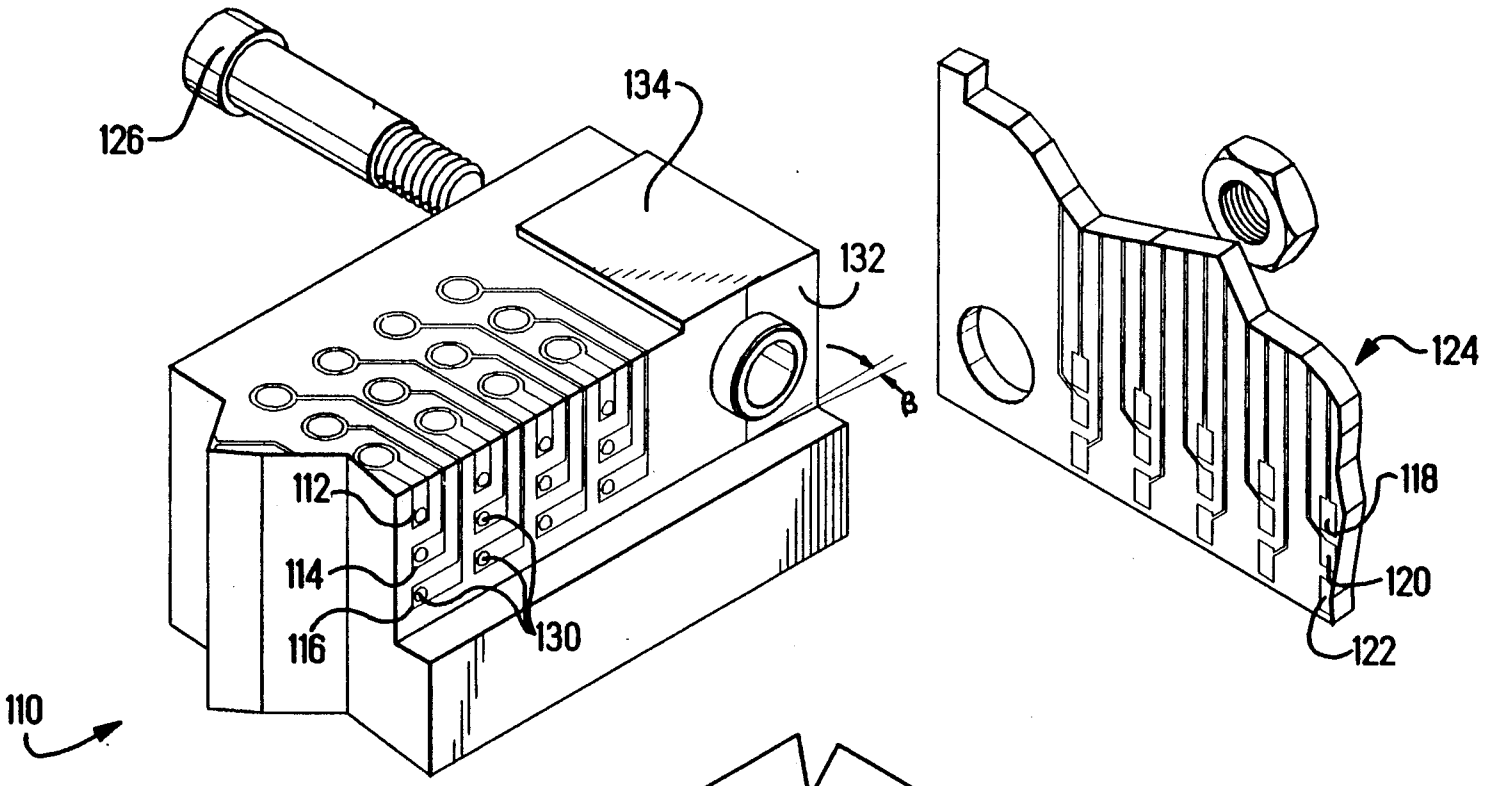
FIG. 8 is a perspective view similar to FIG. 7 of another embodiment of the connector of the present invention.

Another embodiment of connector 110 is shown in FIG. 8 having three rows of pads 112,114,116 which will become electrically engaged with corresponding pads 118,120,122 of daughter board 124 disposed in three rows, when connector 110 is mechanically fastened by fasteners 126. Each of pads 112,114,116 includes deposited thereon an amount of conductive elastomer defining an elastomeric contact 130 having a definite height aspect, so that when connector 110 is fastened to board 124 the elastomeric contacts 130 engage corresponding ones of board pads 118,120,122 to establish an electrical connection between the associated pads. Material for such elastomeric contacts can be for example silicone gel filled with silver plated polymeric particles. A different means is shown to assure that the board surface is urged against connector 110 after fastening and during in-service use when elevated temperatures could otherwise cause distortion of the planarity of the board: the surface 132 of each mounting flange 134 of connector 110 abutting board 124 has been formed to define a slight angle $\beta$ such as about 2° extending toward the board at the outer extreme of each flange. When connector 110 is firmly fastened to board 124 by fasteners 126, the center portion of the edge of board 124 will be forced to assume a gentle arc extending toward connector 110 between mounting flanges 134 thus assuring that even the centermost elastomeric contacts 130 remain in electrical engagement with board pads 118,120,122 during in-service use.

Figure 9:
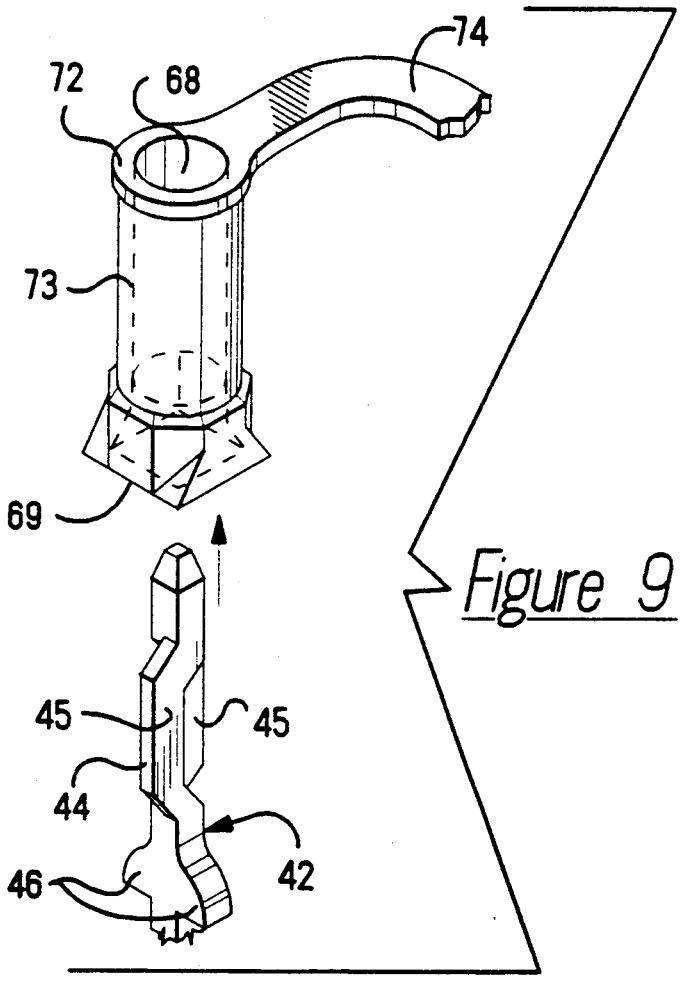
FIG. 9 is a perspective and schematic showing the conductive traces with insulating and supporting material removed from the components forming the circuit in the arrangements of FIGS. 3 to 8.

Cavities 68 are, in accordance with an embodiment of the invention, made to contain a coating such as plating 70 which extends upwardly of cavity 68 and out onto surface 62. FIG. 9 shows coating 70 leading to annular pad 72 which extends along surface 62 in the manner shown as 74; coating 70 also includes a tubular geometry shown as barrel 73. Such use of a compliant pin in a plated cavity of a plastic housing for retention and electrical connection is disclosed in U.S. patent application Ser. No. 07/704,552 filed May 23, 1991 and assigned to the assignee hereof. FIG. 9 also illustrates a contact 42 having a compliant spring portion 44 similar to that disclosed in U.S. Pat. No. 4,186,982, and a corresponding representative plated through-cavity 73 dielectric structure is used in one embodiment of the present invention which extends to a far surface thereof upon which is disposed a conductive trace or path 74 terminating at annular pad 72 surrounding the entrance to through-cavity 73 and integrally joined to the coating or plating 70 of the inside wall surfaces of the surrounding cavity through the dielectric material, with the coating 70 thus defining barrel 73. Compliant spring portion 44 is dimensioned relative to the interior diameter of 73 to fit therewithin and provide a stable low-resistance interface therewith. An enlarged portion of contact 42 such as laterally extending tabs 46 can engage for example a stop surface defined by an enlarged hole entrance 69 to stop axial movement of contact 42 upon reaching the desired depth of contact insertion, as seen in FIG. 5.

In practice, the various conductive paths, including barrels 73 and paths 74, 78, and 82 as well as pads 92,93,94 may all be formed by first applying a catalyst to such areas, electrolessly plating such areas and then building up the conductive bulk by electroplating or electroless plating. This may be done in a number of ways ranging from printing, silk screening, or utilizing a masking technique which activates selectively a coating on the housing only where plating is desired. Reference is made to U.S. Pat. No. 3,745,045 granted Jul. 10, 1973 for a teaching of a method of selectively applying conductive material into cavities and onto the surfaces of dielectric medium utilizing an ink containing a plating catalyst. U.S. Pat. No. 4,872,844 discloses plating traces on selected surface portions and within cavities of a molded plastic adapter substrate. U.S. Pat. Nos. 3,629,185; 4,511,597; 4,532,152; and 4,604,799 disclose techniques for plating of traces on dielectric surfaces, including using electroless or electroplating techniques, or a combination thereof.

The various paths heretofore discussed may be shaped with respect to thickness and height to provide a balance of R as between the different paths. Thus, the path defined by 82 can be made thinner or less wide than path 92, which in turn can be made restricted relative to path 90 so that the resistance of the three paths is essentially identical. With the arrangement shown and just described, the conductive paths will have been shortened considerably and meaningfully relative to that of the paths shown in FIGS. 1 and 2. Also in accordance with the invention concept, the spacing between the paths can be controlled to reduce C as much as possible with the bends both in the plane of 62 and around the corner to the step are radiused to minimize L. In this regard, electropolishing of the conductive path edges to preclude points and sharp radiuses can also be employed to minimize not only quantitative values of C and R, but field fringing effects and the like.

With respect to the use of plated-through holes in conjunction with the compliant pin as heretofore described, it has been discovered that a compliant pin may be made to work in plastics of a type readily molded to have characteristics allowing plating thereon. Preferred plastics are selected for minimal resilience and high stress modulus, and almost isotropic shrinkage after molding. For example, the thickness of plating, which may be comprised of copper and electroless nickel to form the thickness of the plating shown in FIG. 9 as 73, is on the order of at least 0.0015 inches. Thicknesses which are the equivalent of one ounce copper are formed to create the conductive paths on the surfaces of the connector and the pads thereon may be employed as well. A pin having a split beam compliant spring section made in accordance with U.S. Pat. No. 4,186,982 and appropriately dimensioned has been formed to provide an excellent elevational interface as well as resisting axial movement. Examples of such compliant pins are sold by AMP Incorporated of Harrisburg, PA under the trademark ACTION PIN contacts such as Part Nos. 2-532420-0 (0.025 inch square posts) and 534503-8 (0.015 inch square posts) recommended for use with printed circuit boards of conventional epoxy/fiberglass construction having through-holes drilled therethrough which are then copper plated and tin-lead overplated and have nominal plated diameters of 0.040 inches (but commonly ranging from 0.037 to 0.043 inches) and 0.024 inches (from 0.022 to 0.026 inches) respectively, and after insertion of the compliant spring section into such a hole with a forty pound force (maximum) the designed retention force range is from at least eight pounds to about twenty-five pounds. The present invention may also be used with compliant pins of other conventional compliant spring construction which achieve an interference fit of similar retention force levels.

For use with the present invention, it is preferred that for contacts 42 matable with socket contacts of a connector 18, a pair of tabs 46 be formed on each contact to define an enlarged contact portion to be inserted into an enlarged cavity entrance 69 in a substantial interference fit of about two to five pounds until seated against the top shoulder defined by the smaller diameter of cavity 68, which establishes not only additional resistance to pull-out but also stable axial alignment of contact 42 in passageway 68 since contact 42 will be subjected to stresses during mating with and unmating from contacts of mother board connector 18.

In the present example such a pin after insertion into the plated cavity of the plastic housing, would have a nominal pull-out force of about 3.5 pounds resulting from the compliant spring compression (and an additional pull-out force of from two to five pounds from the force-fit shoulder 46). The plating material defines a barrel having a strong hoop strength to compress the spring of the compliant pin upon insertion without being substantially deflected or deformed radially outwardly, and has been found not to exhibit microcracks. Microcracks in the plating would ordinarily be expected of plating over plastic structure with plastic materials conventionally used for connector housings because of the resilient nature of the supporting plastic undersurface and standard plating thicknesses, when subjected to such a severe interference fit concentrated at two opposed radial locations 45A by the two legs 45 of the split-beam spring portion 44 of pin 42.

Figure 12:
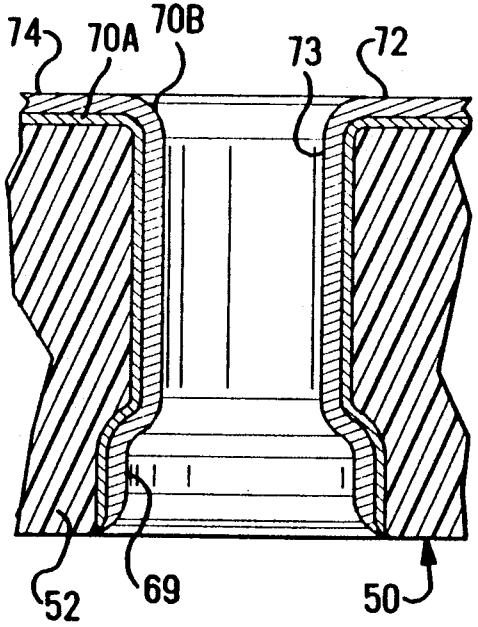
FIGS. 10 to 12 illustrate the fabrication of a plated-through cavity of a molded housing by plating an initial layer and a thick subsequent layer of conductive material.
Figure 11:
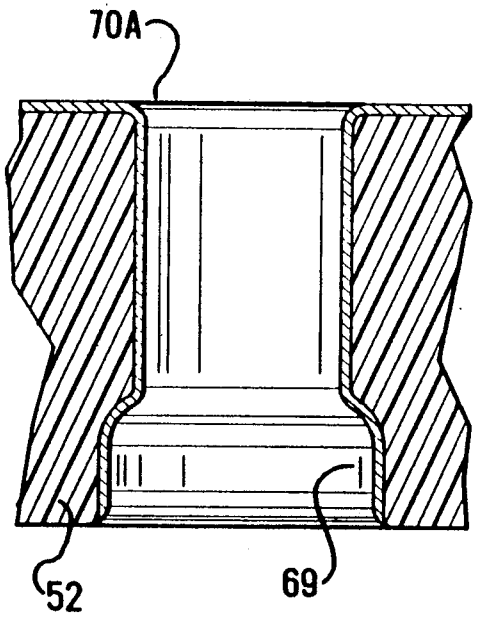
Figure 10:
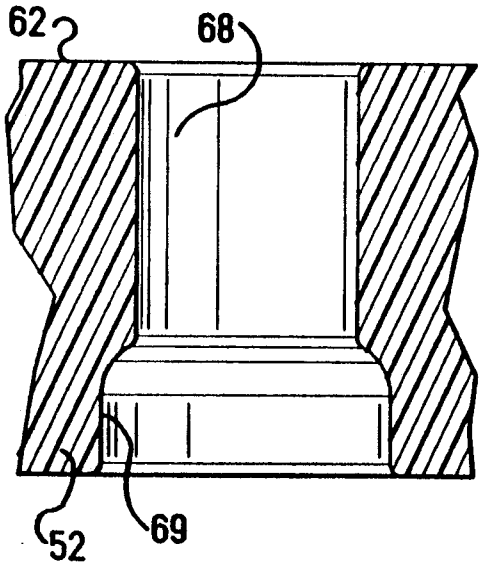
Figure 13:
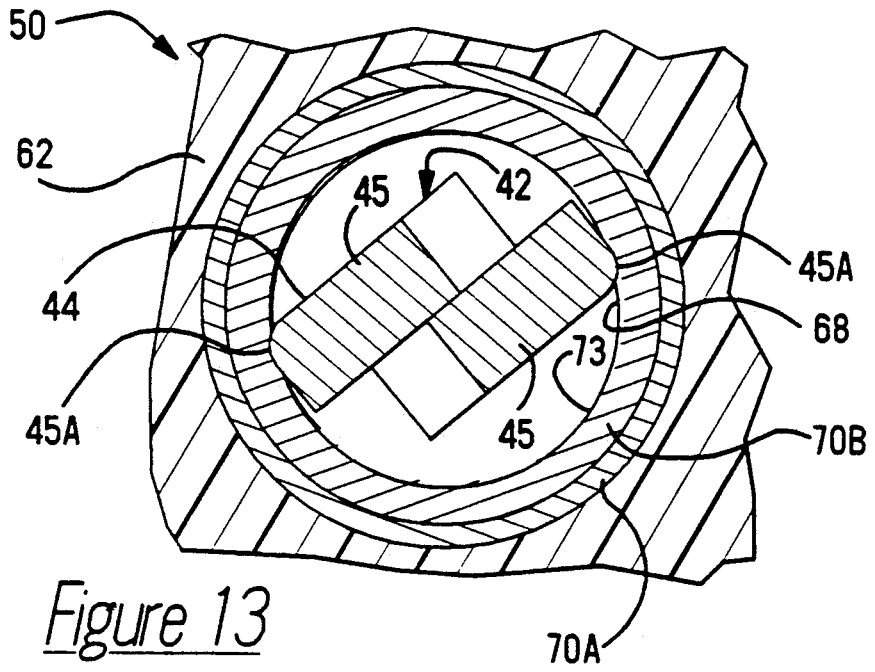
FIG. 13 is an enlarged cross-section of a plated-through cavity after a compliant spring section has been force fit thereinto for retention and electrical connection to the conductive plating material.

One example of a connector for use with compliant pins 42 is fabricated as indicated in FIGS. 10 to 12: a housing 52 is molded of a resin having low resilience and almost isotropic shrinkage after curing, such as VICTREX amorphous polyethersulfone resin (trademark of ICI Americas Corporation), or ULTEM amorphous thermoplastic polyetherimide resin (trademark of General Electric Company). Molded housing 52 has cavities 68 of unplated diameters of about 0.047 inches; a first layer 70A of conductive material such as copper is electrolessly plated onto all exposed surfaces of connector housing 52 including the side walls of cavities 68,69 to a thickness of about 50 microinches after which a plating resist mask is adhered onto the portions of the outer surfaces which are not to be circuits; and a second layer 70B of conductive material such as copper is then electroplated onto exposed surfaces of first layer 70A to a thickness of about 0.0014 inches after which the plating resist and the underlying portions of the first layer are removed chemically and the circuits remaining preferably being overplated with gold over nickel, with all of the steps generally being by conventional techniques. As a result the inside diameter of each cavity 68 is about 0.044 inches; plated diameters useful in the present invention can range from about 0.041 to 0.045 inches. A split-beam compliant pin 42 as disclosed in U.S. Pat. No. 4,186,982, is made of phosphor bronze gold plated with nickel underplating with a post section 0.025 inches on a side, to have a diagonal of about 0.050 inches prior to compression at the spring portion, and a nominal pull-out force of up to about eight to twelve pounds upon insertion into a hole of 0.040 inches nominal inside diameter such as a circuit board through-hole.

An alternate method would be to provide a housing having an ultraviolet sensitive catalyst in the plastic, providing a UV-opaque mask over the noncircuit surface portions of the housing surface, illuminating the housing with ultraviolet light and activating the catalyst in the unmasked regions, cultivating metal ion growth in the unmasked regions, electrolessly plating a thin first layer of copper to the metal ions, and electrolessly plating a thick second layer of copper thereover, defining the circuits.

Figure 14:
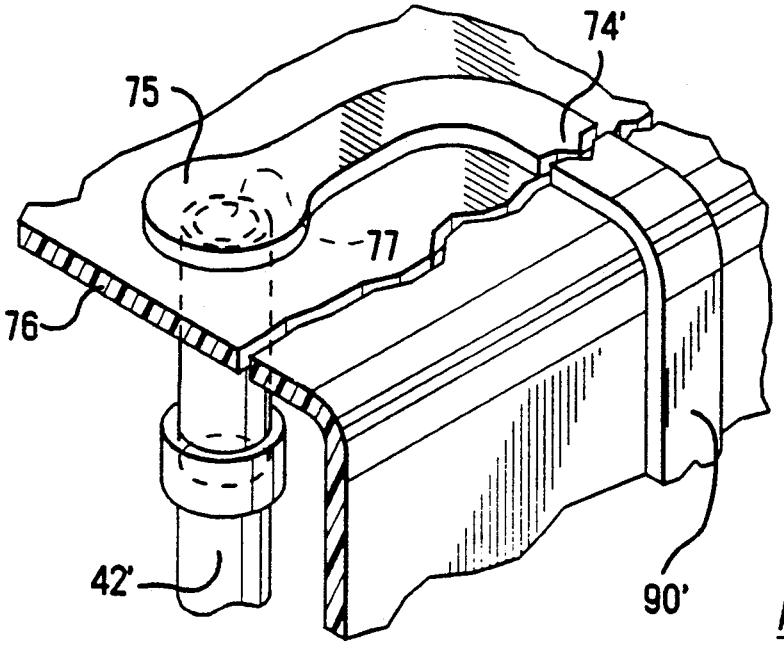
FIG. 14 is a perspective showing an alternative version for forming conductive paths for the connector of FIGS. 3 to 7.

FIG. 14 shows an alternative construction wherein the conductive paths are formed on a thin plastic film placed directly on the surface of the connector housing, the film then being bonded to such surface. In FIG. 14 annular pad 72 as shown in FIG. 9 is replaced by a flat solid pad 75 joining path 74' and pad 90' on the surface of a thin film 76. Film 76 may be of a polyester or polyamid material on the order of between 0.002 and 0.005 inches in thickness. Pin contact 42' may, in lieu of the compliant pin, include an upper portion made to extend through film 76 by an aperture 77 shown in phantom in FIG. 14 and be permanently joined to solid pad 75 in a number of ways, including the use of other conductive adhesive material, welding, or the like.

With respect to the embodiments of the invention shown in FIGS. 9 and 14, the conductive paths are contemplated as being formed by either additive or subtractive electrochemical processes meaning that the paths may be formed simultaneously for a given connector or in fact for many connectors or etched films to very tight tolerances, formed by processes by the same type utilized to form the printed circuit boards with which the connectors are used. The various geometries possible utilizing the concepts of the invention heretofore described will improve the R, L, and C associated with signal transmission and yet be fully compatible with existing geometries of mother and daughter boards and widely used bus architecture, the essential change required only relating to the provision of pads 36 which are frequently found in any event on daughter boards and the substitution of the connector geometry shown along with the use of conductive elastomers or conductive adhesives. The improvements in performance should suffice for many applications, particularly where pulse rise times are on the order of more than 2 nanoseconds. The invention heretofore described has emphasized a number of different embodiments with respect to plating, coating, or otherwise forming conductive paths on the surfaces of the connector housings, such paths being bound to such surfaces or to a film which is in turn bound to the surfaces of the connector. The invention contemplates that the various embodiments of forming conductive pads directly on the housing material or on a film may be utilized with the various embodiments incorporating transceiver chips into the connectors.

Having now described the invention in terms intended to enable the preferred practice of the various embodiments thereof, claims are appended intended to define what is inventive.

What is claimed is:

1. A system for interconnecting circuits of circuit boards, comprising:

an assembly of first and second printed circuit boards and connectors with each connector associated with a respective said second circuit board and comprising:

a plastic housing of dielectric material having arrays of contacts associated with corresponding contacts of circuit paths of a first circuit board, said housing including an array of cavities associated with respective ones of said contacts, each said contact retained in a said cavity of said housing and having a contact portion at least exposed along a mating face of said housing for electrical connection to a respective one of said first board contacts, each said cavity having conductive means therein joining said contact and extending to define a conductive path therethrough to the surface of said housing to join further conductive material extending onto an exterior surface of said housing remote from said mating face, said conductive material bound to said exterior surface to define flat conductive paths for respective said contacts, and each said path spaced from others thereof to be insulated to define a distinct conductive path, at least certain said conductive paths extending to end in contact pads bound to a selected surface portion of said housing facing and parallel to an opposed major surface portion of said respective second circuit board with said pads arranged in a pattern corresponding with a like pattern of pads of circuit paths of said second corresponding circuit board arrayed on said major surface portion;

means mechanically joining each said connector to a respective said second circuit board with said selected surface portion and said major surface portion adjacent each other; and means at least electrically engaging associated ones of said contact pads of each said connector and pads of said second circuit board without solder.

2. The system of claim 1 wherein said conductive material in said cavities is formed of a plating material bound to interior surfaces of said cavities.

3. The system of claim 1 wherein said conductive material on said exterior surface of said housing is formed of a plating material bound to said exterior surface.

4. The system of claim 1 wherein said conductive material on said exterior surface of said housing is formed on a flat insulating film containing conductive material bound thereto with said film being bound to said housing by adhesive or the like.

5. The system of claim 1 wherein said conductive material within said cavities is formed of plating material and each of said contacts of said connector includes a compliant spring portion inelastically deformed by insertion within a said cavity to provide an interconnection with said plating material.

6. The system of claim 1 wherein said contact pads are joined to respective pads of said second circuit board by respective thin layers of conductive material.

7. The system of claim 6 wherein there is additionally provided means clamping said second circuit board to said connector to urge together said selected surface portion and said major surface portion at all locations therealong to maintain the interconnection between said associated pads.

8. The system of claim 6 wherein said connector includes surface areas at each end of said selected surface portion abutting said second circuit board when fastened, said surface areas disposed at slight angles extending forwardly and laterally outwardly from said selected surface portion so that upon full fastening of said second circuit board to said connector against said surface areas, said second circuit board is forced to tend to assume a slight arc therebetween extending toward said selected surface area assuring electrical engagement between said associated pads.

9. The system of claim 6 wherein said conductive material is a conductive elastomer.

10. The system of claim 9 wherein said conductive material is a conductive adhesive.

11. A connector for interconnecting multiple circuit paths as between the paths supplied by bus means in a mother board through a connector thereon having contacts arranged in multiple rows, and associated paths of a daughter board, comprising:

a plastic housing containing cavities and contacts mounted in said cavities in rows to extend therefrom to mate with said connector of said mother board, each of said cavities containing a conductive material extending onto a surface of said housing opposite to said contacts and being bound to the surface to form circuit paths, the conductive material extending to form contact pads on a selected surface portion of said housing facing a major surface portion of said daughter board, said contact pads arranged in rows corresponding with said pads on said major surface portion of said daughter board;

means to secure said connector housing to said daughter board; and a conductive medium joining said pads of said connector to respective said pads of said daughter board.

12. The connector of claim 11 wherein said connector includes surface areas at each end of said selected surface portion abutting said daughter board when fastened, said surface areas disposed at slight angles extending forwardly and laterally outwardly from said selected surface portion so that upon full fastening of said daughter board to said housing against said surface areas, said daughter board is forced to tend to assume a slight arc therebetween extending toward said selected surface area assuring electrical engagement between said associated pads.

13. The connector of claim 11 wherein said conductive medium is a conductive gel deposited on each said contact pad and having a selected height extending outwardly from said selected surface portion of said housing to be engaged by a respective said pad of said daughter board upon said housing being fastened to said daughter board.

14. A connector for interconnecting circuits of a type using fast rise time digital pulses wherein values of circuit parameters including R, L, C, and propagation delays are critical to signal transmission and propagation, said connector being adapted to be mounted between arrays of contacts of said circuits and having a plastic housing of dielectric material and including arrays of contacts adapted to mate with said contacts of said circuits, said housing including an array of conductive paths for respective said contacts, said paths being separated electrically and ending in pads, said conductive paths are bound to surfaces of said connector and of a geometry to minimize path length, and said paths are formed as by plating on surfaces of said housing.

15. The connector of claim 14 wherein a thin film includes said conductive pads formed thereon with said film being bound to a surface of said connector.

16. The connector of claim 14 wherein said arrays of contacts include contacts in different planes with certain ones of said contacts in a given plane interconnected with certain corresponding ones of said contacts in an outer plane by said conductive paths to common circuits for power and/or ground interconnection.

17. The connector of claim 14 wherein each said electrical contact for each said cavity includes a forward mating portion and a further portion of a geometry to define a compliant spring operable upon said contact being inserted into a corresponding said cavity to be compressed radially by plastic of said housing of said cavity in conjunction with said given thickness of said plating to form a low resistance stable interface.

18. The connector of claim 17 wherein said compliant spring is of a dimension radially to provide radial forces sufficient to prevent axial pullout of said contact with respect to said housing.

19. The connector of claim 17 wherein said contact include means thereon adapted to resist axial displacement.

20. The connector of claim 17 wherein the said given thickness of said material is on the order of 0.0015 inches or greater.

* * * * *